US006984930B2

(12) United States Patent
Döll

(10) Patent No.: US 6,984,930 B2
(45) Date of Patent: Jan. 10, 2006

(54) DISCHARGE LAMP WITH IGNITION AID OF A UV/VIS MATERIAL HAVING HIGH SECONDARY ELECTRON EMISSION COEFFICIENT

(75) Inventor: Gerhard Döll, Ulm (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 238 days.

(21) Appl. No.: 10/451,395

(22) PCT Filed: Jul. 4, 2002

(86) PCT No.: PCT/DE02/02455

§ 371 (c)(1),
(2), (4) Date: Jun. 23, 2003

(87) PCT Pub. No.: WO03/019615

PCT Pub. Date: Mar. 6, 2003

(65) Prior Publication Data

US 2004/0046490 A1 Mar. 11, 2004

(30) Foreign Application Priority Data

Aug. 17, 2001 (DE) ..... 101 40 355

(51) Int. Cl.
*H01J 61/46* (2006.01)

(52) U.S. Cl. ..... 313/485; 313/493

(58) Field of Classification Search ..... 313/607, 313/234, 491–493, 481–485
See application file for complete search history.

(56) References Cited

U.S. PATENT DOCUMENTS

| | | | | |
|---|---|---|---|---|
| 5,006,758 | A | 4/1991 | Gellert et al. | |
| 5,604,410 | A | 2/1997 | Vollkommer et al. | |
| 5,994,849 | A | 11/1999 | Vollkommer et al. | |
| 6,034,470 | A | 3/2000 | Vollkommer et al. | |
| 6,097,155 | A * | 8/2000 | Vollkommer et al. | 315/58 |
| 6,249,079 | B1 | 6/2001 | Vollkommer et al. | |
| 6,340,862 | B1 | 1/2002 | Lecheler et al. | |

FOREIGN PATENT DOCUMENTS

| | | |
|---|---|---|
| EP | 0 363 832 | 4/1990 |
| EP | 1 085 554 | 3/2001 |
| WO | 99/54915 | 10/1999 |
| WO | 00/58998 | 10/2000 |

* cited by examiner

*Primary Examiner*—Joseph Williams
(74) *Attorney, Agent, or Firm*—Robert F. Clark

(57) ABSTRACT

A dielectric barrier discharge lamp having electrodes arranged on the wall of the discharge vessel has a VUV/VIS reflection layer (6) made of a material with a high secondary electron emission coefficient on at least a part of the inner wall of the discharge vessel. A luminescent material layer (7) is in turn applied on the VUV/VIS reflection layer (6). Moreover, at least one partial region (8) without luminescent material is provided in the luminescent material layer (7), this at least one partial region (8) partially uncovering the underlying VUV/VIS reflection layer (6) and additionally being arranged at least in direct proximity to one or more electrodes (4) of the lamp. As a result, the ignition behavior of the lamp is improved, in particular during ignition in darkness.

15 Claims, 1 Drawing Sheet

DISCHARGE LAMP WITH IGNITION AID OF A UV/VIS MATERIAL HAVING HIGH SECONDARY ELECTRON EMISSION COEFFICIENT

TECHNICAL FIELD

The invention relates to a dielectric barrier discharge lamp.

Dielectric barrier discharge lamps are sources of electromagnetic radiation based on dielectrically impeded gas discharges.

The discharge vessel is usually filled with a noble gas, for example xenon, or a gas mixture. So-called excimers are formed during the gas discharge, which is preferably operated by means of a pulsed operating method described in U.S. Pat. No. 5,604,410. Excimers are excited molecules, e.g. $Xe_2^*$, which emit electromagnetic radiation upon returning to the generally unbonded ground state. In the case of $Xe_2^*$, the maximum of the molecular band radiation lies at approximately 172 nm (VUV radiation).

The present invention relates to a dielectric barrier discharge lamp having a luminescent material layer which is applied on the inner wall of the discharge vessel and serves for converting the invisible VUV radiation into visible (VIS) radiation (light). A VUV/VIS reflection layer, for example $Al_2O_3$ and $TiO_2$, is applied below the luminescent material layer on a part of the inner wall of the discharge vessel. This increases the luminous efficiency of the lamp. This is because the VUV/VIS reflection layer on the one hand reflects that proportion of the short-wave radiation emitted by the gas discharge which initially passes through the luminescent material layer back into the luminescent material layer. Otherwise this proportion would for the most part be absorbed by the discharge vessel wall and would thus be finally lost for the conversion into light by the luminescent material layer. On the other hand, the reflection layer also reflects the visible light, however, so that it is radiated only via the reflection-layer-free region of the discharge vessel. In this respect, the reflection layer serves for increasing the luminance in the lamp region provided for light radiation.

The form of the discharge vessel of the lamp plays at most a secondary part for the advantageous effect of the invention. In particular, the invention also relates to so-called flat lamps and bar-type aperture lamps.

In flat lamps, the discharge vessel is essentially formed by a baseplate and a front plate connected thereto. The VUV/VIS reflection layer is applied on the inner wall of the baseplate. Thus, the light radiation is in this case effected via the front plate. Flat lamps are suitable in particular for large-area illumination tasks, for example for the direct backlighting of displays, e.g. liquid crystal displays, but also for general illumination.

In bar-type aperture lamps, an aperture extending along the longitudinal axis of the lamp remains free of reflection layer. The aperture may optionally likewise be free of luminescent material or be coated with luminescent material. Lamps of this type are used in particular in apparatuses for office automation (OA), e.g. color copiers and scanners, for signal illumination, e.g. as breaking and direction indicating light in automobiles, for auxiliary illumination, e.g. the internal illumination of automobiles, and for the background illumination of displays, e.g. liquid crystal displays, as so-called "edge type backlights".

A dielectric barrier discharge lamp necessarily presupposes at least one so-called dielectrically impeded electrode. A dielectrically impeded electrode is isolated from the interior of the discharge vessel by means of a dielectric barrier. This dielectric barrier may be embodied, for example, as a dielectric layer covering the electrode, or it is formed by the discharge vessel of the lamp itself, namely if the electrode is arranged on the outer wall of the discharge vessel.

The dielectric barrier means that operation of lamps of this type requires a time-variable voltage between the electrodes, for example a sinusoidal AC voltage or pulsed voltage as disclosed in U.S. Pat. No. 5,604,410 mentioned above.

PRIOR ART

U.S. Pat. No. 6,034,470 discloses a flat lamp with dielectrically impeded electrodes. The discharge vessel of the lamp comprises a baseplate and a front plate, which are connected to one another in a gastight manner via a peripheral frame. The baseplate is provided with a light-reflecting layer, i.e. only the front plate serves for coupling out light. The inner wall both of the baseplate and of the front plate is coated with a luminescent material layer (FIG. 6*b*). As a result, a high luminous efficiency or high luminance is obtained on the front plate. What is disadvantageous, however, is the long ignition delay after the application of the voltage to the electrodes of the lamp if the lamp is in darkness, for example within an LCD display. After some time in darkness, it can even happen that the lamp can only be ignited with a significantly increased voltage compared with normal operation.

EP-A 363 832 shows a flat lamp with dielectrically impeded electrode pairs which are connected pairwise to the two poles of a high-voltage source. The electrodes comprise wires and are embedded in a planar glass dielectric. During operation, creeping discharges form on the dielectric surface between respectively adjacent electrode wires. A coating is applied on the dielectric surface in order to lower the ignition voltage for the discharge. The material for the coating comprises the oxides of magnesium, ytterbium, lanthanum and cerium (MgO, $Yb_2O_3$, $La_2O_3$, $CeO_2$). A luminescent material layer is applied on the outer wall of the transparent plate opposite the glass dielectric. What is disadvantageous is that the dielectric surface has no luminescent material layer, owing to the coating for lowering the ignition voltage, since part of the maximum possible luminous efficiency is thereby relinquished.

SUMMARY OF THE INVENTION

The dielectric barrier discharge lamp according to the invention has a discharge vessel, on the wall of which dielectrically impeded electrodes are arranged. A VUV/VIS reflection layer is applied on at least a part of the inner wall of the discharge vessel. A luminescent material layer is in turn applied on the VUV/VIS reflection layer. Furthermore, according to the invention, a partial region of the VUV/VIS reflection layer is also additionally accorded the function of a secondary electron emitter for the purpose of improving the ignition behavior of the lamp. For this purpose, a material with a high secondary electron emission coefficient is deliberately chosen for the VUV/VIS reflection layer. Moreover, at least one partial region without luminescent material is provided in the luminescent material layer, this at least one partial region partially uncovering the underlying VUV/VIS reflection layer and additionally being arranged at least in direct proximity to one or more electrodes. This means that the at least one partial region is chosen in such a way that the VUV/VIS reflection layer uncovered there is exposed to the free electrons accelerated in the electric field of the electrodes. These electrons can thus release secondary electrons from the VUV/VIS reflection layer within the luminescent-material-free partial region by means of impact processes. In this respect, it is also unimportant for the advantageous effect of the invention whether the electrodes are arranged on the inner wall and covered with a separate dielectric layer or, alternatively, are arranged on the outer wall. All that is essential in this case is that the electric field generated by the electrodes can act on the respective luminescent-material-free partial region in the manner described above. The inner wall electrode is to be given preference only in so far as the thickness of the dielectric layer can be chosen independently of the thickness of the vessel wall. Moreover, the inner wall electrode affords safety against being touched. The luminescent-material-free partial region can be realized by the luminescent material either being subsequently removed there or already having been spared there during application.

It goes without saying that it is also possible to provide two or a plurality of such partial regions within the discharge vessel, in order thereby to increase the probability of rapid ignition.

If the luminescent material layer does not completely cover the inner wall of the discharge vessel, it is not a critical factor, moreover, as to whether the at least one luminescent-material-free partial region is arranged within the outer border of the luminescent material layer or at the edge thereof. The only critical factor is that the luminescent-material-free partial region uncovers the underlying reflection layer and the luminescent-material-free partial region is arranged in the region of an electrode in such a way that secondary electrons are released there during operation.

Although it is possibly also sufficient if the luminescent-material-free partial region adjoins an electrode directly alongside, since electrons can additionally impinge there, too, on account of electric leakage fields, the efficacy of the ignition aid is nontheless higher if the luminescent-material-free partial region is arranged directly above at least one electrode. In addition, the form of the luminescent-material-free partial region is preferably chosen such that it corresponds to the image or at least partial image of an electrode, i.e. the luminescent-material-free partial region is preferably limited to the zone defined by the (partial) image above the electrode.

If the lamp is provided for operation with unipolar voltage pulses, the luminescent-material-free partial region must be arranged on the anode. This is because it is only then that primary electrons can be accelerated in the direction of the luminescent-material-free partial region and, upon impinging on the VUV/VIS reflection layer, secondary electrons can be released there for the further development of the ignition process. In the case of lamps for operation with bipolar voltage pulses, this distinction is insignificant since the electrodes change their roles (instantaneous anode or cathode) in pairs depending on the polarity of the instantaneous voltage pulse.

Moreover, it is advantageous in the case of bipolar operation to arrange a luminescent-material-free partial region above the two electrodes of an electrode pair. This is because it is ensured that for each voltage pulse, independently of the polarity thereof, the instantaneous anode in any event has a luminescent-material-free partial region and a secondary electron emission can thus take place. Moreover, the probability of rapid and reliable ignition is increased in the case of this variant. In this case, the two luminescent-material-free partial regions may be either separate from one another or contiguous to form a common partial region for both electrodes. The common partial region is appropriate in particular for relatively closely adjacent electrodes of an electrode pair. In the case of electrodes that are further apart from one another, separate partial regions will be preferred in order to lose the smallest possible proportion of the luminescent material layer and thus also of the luminous efficiency.

To ensure the functionality as secondary electron emitter, a material with a secondary electron emission coefficient greater than one, in particular greater than two, preferably greater than 3, particularly preferably in the range between 3 and 15, is chosen for the VUV/VIS reflection layer. By way of example, porous $Al_2O_3$ and/or MgO have proved to be suitable coating material.

In a preferred embodiment, the discharge vessel is essentially formed by a baseplate and a front plate connected thereto. The VUV/VIS reflection layer is applied on the inner wall of the baseplate. Elongate electrodes spaced apart from one another are arranged below the reflection layer, at least the electrodes of one polarity being covered with a dielectric layer, for example made of glass solder. As an alternative, the electrodes can also be arranged on the outer wall of the discharge vessel. The vessel wall itself then functions as a dielectric. In any event, the luminescent material layer is arranged on the reflection layer and is provided with at least one luminescent-material-free partial region in the manner described above. For further details, reference is made to the exemplary embodiment.

The discharge vessel may also be tubular, the VUV/VIS reflection layer, with the exception of a reflection-layer-free aperture extending along the longitudinal axis of the lamp, extending on the inner wall of the discharge vessel. Here, too, it is unimportant for the advantageous effect of the invention whether the electrodes are arranged on the inner wall and covered with a separate dielectric layer or, alternatively, are arranged on the outer wall.

BRIEF DESCRIPTION OF THE DRAWINGS

The invention will be explained in more detail below using the example of a flat lamp. However, the advantages of the invention are also valid in the case of other vessel geometries, in particular also in the case of lamps having a tubular discharge vessel. In the figures.

PREFERRED EMBODIMENT OF THE INVENTION

Figure 1A:
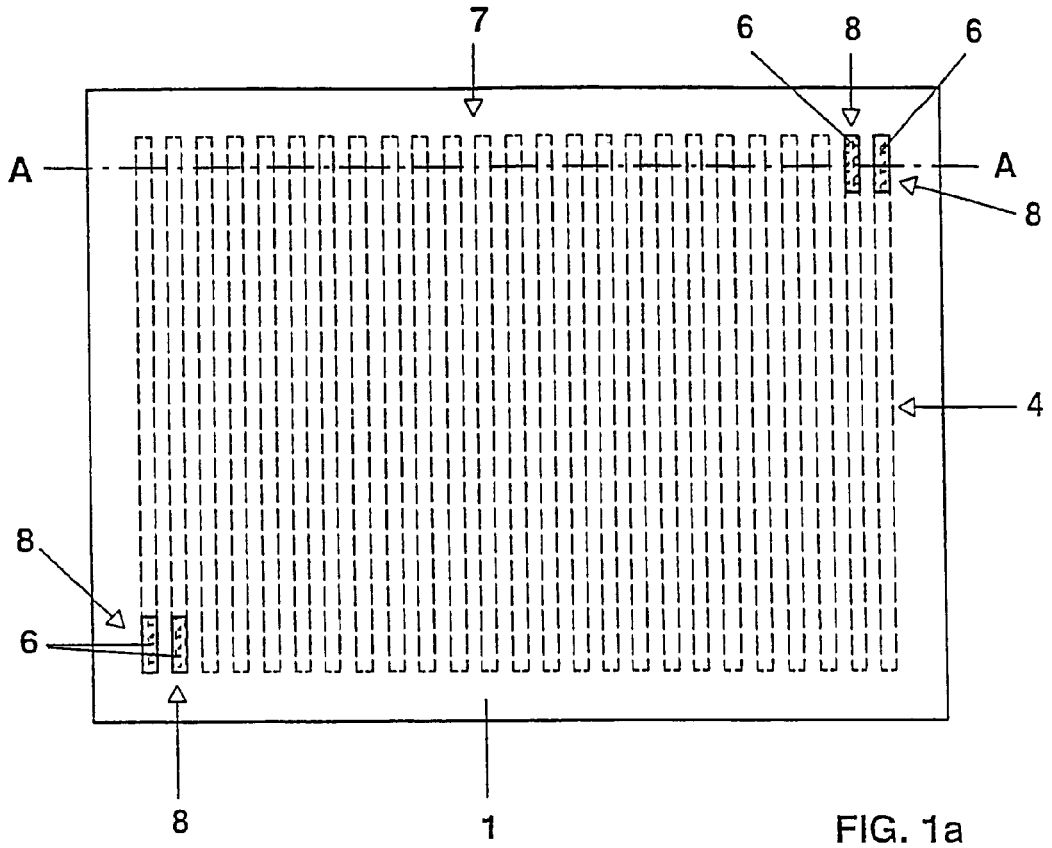
FIG. 1*a* shows a diagrammatic plan view of a baseplate of a flat lamp.
Figure 1B:
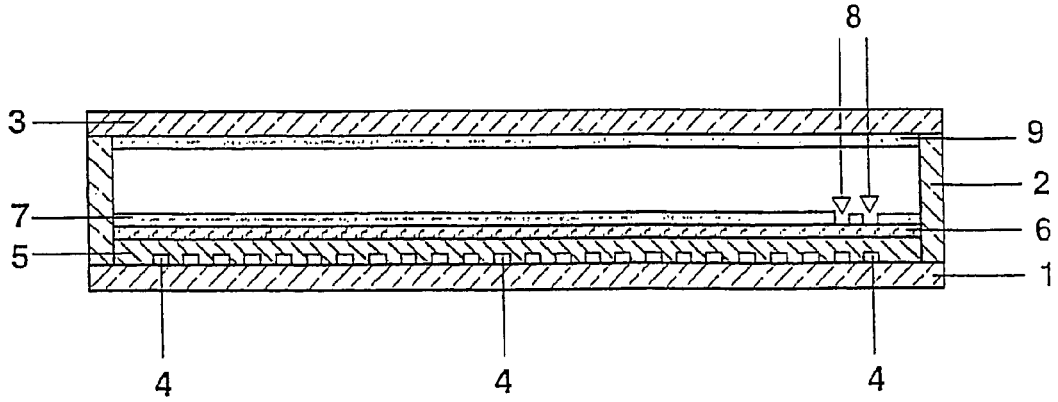
FIG. 1*b* shows a cross section through a complete flat lamp based on the baseplate in FIG. 1*a* along the line AA.

FIGS. 1*a* and 1*b* show a diagrammatic plan view of a baseplate 1 of a flat lamp and, respectively, a cross section through a complete flat lamp based on the baseplate 1 in FIG. 1*a* along the line AA.

The baseplate 1 is connected to a front plate 3 by means of a peripheral frame 2 to form a gastight flat discharge vessel. A gas filling of xenon with a filling pressure of 10 kPa is situated within the flat lamp. Numerous strip-like electrode tracks 4 made of conductive silver solder having a width of approximately 1 mm and a thickness of approximately 10 $\mu$m are printed on the inner wall of the baseplate 1. Their distance from one another is approximately 6 mm. For operation, the strip-like electrodes 4 are alternately connected to one of the two poles of a voltage source which supplies a pulse voltage sequence. As a result, numerous partial discharges form between the directly adjacent electrode tracks. In this case, the partial discharges start essentially beside one another along the electrode track (more precisely above the topmost functional layer covering the electrode tracks) of one (instantaneous) polarity, reach into the gas-filled discharge space and end on the topmost functional layer covering the adjacent electrode with the (instantaneously) opposite polarity. For further details in this respect, reference is made to U.S. Pat. No. 5,994 849. The electrodes 4 and the surrounding inner wall of the baseplate 1 are followed by a dielectric layer 5 made of glass solder whose thickness is approximately 250 $\mu$m. The dielectric layer 5 is followed by a VUV/VIS reflection layer 6 made of $Al_2O_3$, and the latter is followed, finally, by a luminescent material layer 7, comprising a three-band luminescent material mixture for generating white light. The luminescent material layer 7 has four luminescent-material-free partial regions 8, in which the VUV/VIS reflection layer 6 arranged below the luminescent material layer 7 appears. To that end, the corresponding regions of the VUV/VIS reflection layer 6 were covered prior to printing with the luminescent material. In terms of form, the luminescent-material-free partial regions 8 correspond to a partial image of the strip-like electrodes 4, to be precise corresponding to a strip having a length of approximately 5 mm. In each case two of the total of four luminescent-material-free partial regions 8 are arranged at the two sides of the baseplate 1 which run parallel to the electrodes 4, and also at a respective end of the two outer electrodes 4. In this way, although the luminescent-material-free partial regions 8 are arranged in the edge region of the visible area of the flat lamp, they are nevertheless arranged within the electric field of the electrodes 4. Consequently, within the luminescent-material-free partial regions 8, the VUV/VIS reflection layer 6 functions as a secondary electron emitter and thus improves the ignition capability of the lamp. The inner wall of the front plate 3 is likewise coated with a luminescent material layer 9, comprising the luminescent material mixture of the luminescent material layer 7 of the baseplate.

What is claimed is:

1. A dielectric barrier discharge lamp, comprising:

a discharge vessel having a VUV/VIS reflection layer applied on an inner wall of the discharge vessel, dielectrically impeded electrodes arranged under the VUV/VIS reflection layer, a luminescent material layer applied over the VUV/VIS reflection layer, the material of the VUV/VIS reflection layer having a secondary electron emission coefficient greater than one, the luminescent material layer having at least one luminescent-material-free partial region arranged above and in direct proximity to at least one of the dielectrically impeded electrodes so that a portion of the underlying VUV/VIS reflection layer is uncovered within the at least one partial region.

2. The lamp of claim 1 wherein the material of the VUV/VIS reflection layer has a secondary electron emission coefficient between 3 and 15.

3. The lamp of claim 1 wherein the material of the VUV/VIS reflection layer is selected from $Al_2O_3$, MgO or a combination thereof.

4. The lamp of claim 1 wherein the at least one of the dielectrically impeded electrodes is an anode.

5. The lamp of claim 1 wherein the dielectrically impeded electrodes are a strip-like electrodes and the at least one luminescent-material-free partial region has a width no greater than a width of the strip-like electrodes.

6. A dielectric barrier discharge lamp, comprising:

a discharge vessel having a base plate, a front plate, and a peripheral frame connecting the front plate and the base plate, strip-like dielectrically impeded electrodes arranged on an inner wall of the base plate, a VUV/VIS reflection layer applied on the inner wall of the base plate and covering the electrodes, a luminescent material layer applied on the VUV/VIS reflection layer, the material of the VUV/VIS reflection layer having a secondary electron emission coefficient greater than one, the luminescent material layer having at least one luminescent-material-free partial region above and in direct proximity to at least one of the electrodes so that a portion of the underlying VUV/VIS reflection layer is uncovered within the at least one partial region.

7. The lamp of claim 6 wherein the material of the VUV/VIS reflection layer has a secondary electron emission coefficient between 3 and 15.

8. The lamp of claim 6 wherein the material of the VUV/VIS reflection layer is selected from $Al_2O_3$, MgO or a combination thereof.

9. The lamp of claim 6 wherein the at least one of the electrodes is an anode.

10. The lamp of claim 6 wherein the lamp has a dielectric layer between the base plate and the VUV/VIS reflection layer.

11. The lamp of claim 6 wherein the at least one luminescent-material-free partial region has a width no greater than a width of the electrodes.

12. The lamp of claim 6 wherein the lamp is rectangular and has at least two luminescent-material-free partial regions arranged in opposite corners of the lamp.

13. The lamp of claim 6 wherein the lamp has at least one pair of luminescent-material-free partial regions that are arranged directly above two adjacent electrodes.

14. The lamp of claim 13 wherein the lamp is rectangular and has at least two pairs of luminescent-material-free partial regions arranged in opposite corners of the lamp.

15. The lamp of claim 13 wherein the at least one pair of luminescent-material-free partial regions is contiguous and forms a common partial region.

* * * * *